US011319648B2

(12) United States Patent
Nishikawa et al.

(10) Patent No.: US 11,319,648 B2
(45) Date of Patent: May 3, 2022

(54) STABILIZED FIBER BUNDLE AND METHOD OF MANUFACTURING CARBON FIBER BUNDLE

(71) Applicant: Toray Industries, Inc., Tokyo (JP)

(72) Inventors: Yuki Nishikawa, Iyo-gun (JP); Takahiro Ito, Iyo-gun (JP); Hiroyuki Kaiki, Iyo-gun (JP)

(73) Assignee: Toray Industries, Inc., Tokyo (JP)

( * ) Notice: Subject to any disclaimer, the term of this patent is extended or adjusted under 35 U.S.C. 154(b) by 193 days.

(21) Appl. No.: 16/768,923

(22) PCT Filed: Jan. 17, 2019

(86) PCT No.: PCT/JP2019/001228
§ 371 (c)(1),
(2) Date: Jun. 2, 2020

(87) PCT Pub. No.: WO2019/146487
PCT Pub. Date: Aug. 1, 2019

(65) Prior Publication Data

US 2021/0222330 A1 Jul. 22, 2021

(30) Foreign Application Priority Data

Jan. 26, 2018 (JP) ..... JP2018-011166

(51) Int. Cl.
*D01F 9/22* (2006.01)
*D02J 13/00* (2006.01)

(52) U.S. Cl.
CPC ..... *D01F 9/225* (2013.01); *D02J 13/005* (2013.01)

(58) Field of Classification Search
CPC .. D01F 9/22; D01F 9/225; D02J 13/00; D02J 13/005
USPC ..... 264/29.2, 29.6, 83, 331.16, 345; 423/447.4, 447.7
See application file for complete search history.

(56) References Cited

U.S. PATENT DOCUMENTS 4,814,129 A * 3/1989 Imai ..... D01F 9/225 264/29.2 X

FOREIGN PATENT DOCUMENTS

| | | | |
|---|---|---|---|
| JP | S53-52735 | A | 5/1978 |
| JP | S58-36216 | A | 3/1983 |
| JP | S61-138739 | A | 6/1986 |
| JP | H01-118623 | A | 5/1989 |
| JP | H05-287617 | A | 11/1993 |
| JP | H06-264310 | A | 9/1994 |
| JP | 2001-131832 | A | 5/2001 |
| JP | 2003-055843 | A | 2/2003 |
| JP | 2006-176909 | A | 7/2006 |

(Continued)

*Primary Examiner* — Leo B Tentoni
(74) *Attorney, Agent, or Firm* — DLA Piper LLP (US)

(57) ABSTRACT

A method manufactures a flame-retardant fiber bundle by flame retarding treatment of a polyacrylonitrile-based precursor fiber at 200-300° C. in an oxidizing atmosphere, wherein a fiber bundle is caused to travel so as to sequentially pass between an nth roller and an (n+1)th roller (n being an integer of at least 1 and no more than [m−1]) in a roller group formed from m (m being an integer of 3 or greater) contiguously set rollers, the roller axes of the m continuously set rollers being parallel to each other and perpendicular to the direction of travel of the fiber bundle, the roller diameter being 5-30 mm, and the specific gravity of the fiber bundle being 1.20-1.50.

7 Claims, 3 Drawing Sheets

(56) References Cited

FOREIGN PATENT DOCUMENTS

| | | | |
|---|---|---|---|
| JP | 2008-115481 | A | 5/2008 |
| JP | 2013-185285 | A | 9/2013 |

* cited by examiner

STABILIZED FIBER BUNDLE AND METHOD OF MANUFACTURING CARBON FIBER BUNDLE

TECHNICAL FIELD

This disclosure relates to a method of manufacturing a stabilized fiber bundle, the method obtaining a high-strength carbon fiber bundle by suppression of adhesion between single fibers in a stabilization process, and a method of manufacturing a carbon fiber bundle.

BACKGROUND

Carbon fiber bundles have a specific strength and specific modulus superior to those of other fibers, and are widely used as reinforcing materials for composite materials not only in sports and aerospace applications, but also in general industrial applications such as automobiles, wind turbines, and pressure vessels. Particularly in the fields of aircraft and automobiles in which weight reduction of airframes and vehicle bodies is strongly demanded from the viewpoint of environment and cost, there is a high demand for carbon fiber bundles, and still higher performance of carbon fiber bundles has been recently demanded. In particular, carbon fiber bundles having high tensile strength have been demanded.

The tensile strength of a carbon fiber bundle depends on the tensile strength of a polyacrylonitrile precursor that is a raw material of the carbon fiber bundle. It is known that factors that greatly affect the tensile strength of a carbon fiber bundle are flaws and toughness.

Examples of flaws include damage and voids that may occur in single fibers due to contact with and adhesion of foreign substances such as dust and metals, damage on the surface of single fibers due to adhesion between the single fibers, and damage of the carbon fiber bundle itself due to, for example, abrasion with rollers, all of which may occur in the manufacturing process of the carbon fiber bundle. Regardless of whether the flaws are formed inside or on the surface layer of the single fibers of the carbon fiber bundle, the carbon fiber bundle may be reduced in its tensile strength with an increase of the size and number of the flaws. In particular, when adhesion is formed between single fibers in the manufacturing process of the carbon fiber bundle, external force acts on the fiber bundle due to tension or the like to separate the adhered single fibers, and the surface layer of the single fibers of the carbon fiber bundle is torn in the direction of the fiber bundle to generate large flaws and greatly reduce the tensile strength.

Further, examples of the factor of the toughness include a skin-core structural difference of the single fibers that constitute the stabilized fiber bundle due to a difference in heat treatment between the surface layer and the inner layer of the single fibers in the stabilization process. If there is a large difference in heat treatment between the surface layer and the inner layer, the stabilized fiber bundle may have reduced toughness, and the carbon fiber bundle tends to have reduced tensile strength.

In general, a polyacrylonitrile carbon fiber bundle is manufactured by a method including heating a polyacrylonitrile precursor fiber bundle in an oxidizing gas atmosphere at 200 to 300° C. to give a stabilized fiber bundle, and then heating the stabilized fiber bundle in an inert gas atmosphere at 1000° C. or more. The polyacrylonitrile precursor fiber bundle usually includes 1,000 to 60,000 single fibers. Since the polyacrylonitrile precursor fiber bundle is combustible, in the stabilization process, the single fibers may adhere to each other during stabilization of the polyacrylonitrile precursor fiber bundle in an oxidizing atmosphere.

Several methods have been made focusing on the adhesion between the single fibers during the manufacture of a carbon fiber bundle and the structural difference between the surface layer and the inner layer of the single fibers.

Japanese Patent Laid-open Publication No. 61-138739 discloses that carbonaceous fibers fused together due to thermal alteration or the like of the fibers themselves are caused to run on a plurality of cylindrical rollers having center axes intersecting with each other to peel the carbonaceous fibers in a state of being displaced laterally on the rollers, whereby the carbonaceous fibers turn supple and dispersibility of single yarns in a matrix resin is improved.

Japanese Patent Laid-open Publication No. 5-287617 discloses that during the convergence of pitch-based carbon fibers, the "fusion" in which a plurality of fibers are integrated with each other to cause a reduction of the tensile strength, or the "agglutination" in which a plurality of fibers are integrated with each other, but can be easily separated into original fibers may occur, and the fiber bundle is spread after precarbonization by passage between ceramic rollers to prevent a reduction of the tensile strength due to convergence.

Japanese Patent Laid-open Publication No. 2013-185285 discloses that in stabilizing a polyacrylonitrile precursor fiber bundle in an oxidizing atmosphere, the fiber bundle is passed on a grooved roller and then spread with a flat roller, that is, the flatness of the running fiber bundle is changed and then the fiber bundle is heat-treated, whereby accumulation of reaction heat during the stabilization treatment is suppressed, and the structural difference between the surface layer and the inner layer of the single fibers due to a difference in the infusibilization reaction rate is reduced to improve the tensile strength of the carbon fiber.

Japanese Patent Laid-open Publication No. 2001-131832 discloses a method of manufacturing a high-strength carbon fiber, the method including passing a precursor fiber bundle on a plurality of solid guide bars to spread the precursor fiber bundle at the level of single fibers, and then stabilizing the spread precursor fiber bundle, thereby suppressing adhesion between the single fibers.

Japanese Patent Laid-open Publication No. 2006-176909 discloses a method of manufacturing a stabilized fiber bundle, the method including, to prevent adhesion between the single fibers on a folding roller due to a high surface temperature of the folding roller during the stabilization treatment of a precursor fiber bundle, blowing the air at 15 to 30° C. to the fiber bundle at a wind speed of 50 to 150 m/s before the precursor fiber bundle comes into contact with the roller to deform and cool the precursor fiber bundle.

Japanese Patent Laid-open Publication No. 58-36216 discloses a method of manufacturing a stabilized fiber bundle including subjecting a fiber bundle during the stabilization treatment to the spreading treatment and then to the stabilization treatment again to solve, during the stabilization treatment, agglutination between the single fibers that may occur at the surface of the single fibers in the fiber bundle obtained by heat-treating an acrylonitrile fiber bundle by stabilization.

The methods described in JP '739 and JP '617 are intended for a pitch-based carbon fiber bundle, and the fusion or agglutination between the single fibers that may occur during the thermal alteration or convergence of the carbon fiber bundle is solved by passing the carbon fiber bundle on a plurality of rollers for peeling or spreading treatment to separate the single fibers. The fiber bundle has a tensile strength of 350 to 360 kgf/mm$^2$, which is not so sufficiently high compared to the tensile strength of a polyacrylonitrile carbon fiber bundle.

In the method described in JP '285, the carbon fiber bundle has high tensile strength. The method, however, has problems that the equipment cost is high due to the need for both the grooved roller and the flat roller before the carbon fiber bundle enters the stabilization treatment oven, and also that the workability at the time of threading is deteriorated.

In the method described in Patent JP '832, the precursor fiber bundle is passed on a plurality of fixing bars and then subjected to the stabilization treatment. The method has a problem that fuzz may occur due to abrasion between the fixing bars and the precursor fiber bundle so that both the tensile strength and process passability may be deteriorated.

In the method described in JP '909, high-speed air of 50 to 150 m/s is blown to the fiber bundle before coming into contact with the folding roller used in the stabilization treatment. Therefore, the method has a problem that fuzz inherent in the fiber bundle may occur so that both the tensile strength and process passability may be deteriorated.

In the method described in JP '216, to solve agglutination between the single yarns, the fiber bundle during the stabilization treatment is bent at an angle of 25 to 60° using a fixing bar, combined gears, or a crimper for bending the fiber bundle and is spread so that the agglutinated single yarns may be separated. JP '216, however, does not describe to what extent the fiber bundle needs to be spread, that is, the spreading ratio of the fiber bundle, nor the roller diameter and the positional relationship between the rollers necessary for sufficient spreading. Moreover, what is described is only the tensile strength of the stabilized fiber obtained by stabilizing the polyacrylonitrile precursor fiber and the fiber tensile strength of the fibrous activated carbon, and it does not mention at all the tensile strength of a carbon fiber such as a polyacrylonitrile carbon fiber. Therefore, the effect of the method of improving the tensile strength of the carbon fiber remains unclear.

It could therefore be helpful to provide a method of manufacturing a stabilized fiber bundle to obtain a high-strength carbon fiber and including spreading, with external force, a fiber bundle during passage on a plurality of continuously arranged small-diameter rollers to bend the fiber bundle so that the adhesion between the single fibers that may occur during the stabilization treatment may be peeled, as well as a method of manufacturing a carbon fiber bundle.

SUMMARY

We thus provide:

The method of manufacturing a stabilized fiber bundle includes the step of: stabilizing a polyacrylonitrile precursor fiber bundle in an oxidizing atmosphere at 200 to 300° C. to manufacture a stabilized fiber bundle, wherein in the stabilizing step, a fiber bundle is made to run, with respect to a roller group including m pieces (where m is an integer of 3 or more) of rollers arranged continuously, to sequentially pass between an n-th roller and an (n+1)-th roller (where n is an integer of 1 or more and (m−1) or less), the m pieces of rollers arranged continuously have roller axes parallel to each other and perpendicular to a running direction of the fiber bundle, the rollers have a roller diameter of 5 to 30 mm, and the fiber bundle has a specific gravity of 1.20 to 1.50, and the method satisfies all of conditions (a) to (d):

(a) $L_n$ satisfies $0.75\times(R_n+R_{n+1})\leq L_n\leq 2.0\times(R_n+R_{n+1})$, wherein $R_n$ [mm] is a roller diameter of an n-th roller, $R_{n+1}$ [mm] is a roller diameter of an (n+1)-th roller, and $L_n$ [mm] is a distance between an n-th roller axis and an (n+1)-th roller axis;

(b) a width $W_0$ of the fiber bundle before coming into contact with a first roller is in a range of $2.0\times10^{-4}$ to $6.0\times10^{-4}$ mm/dtex;

(c) a width $W_2$ of the fiber bundle after leaving an m-th roller satisfies $1.0\leq W_2/W_0\leq 1.1$; and (d) a width $W_1$ of the fiber bundle on second to (m−1)-th rollers satisfies $W_1/W_0\geq 1.4$ in all the second to (m−1)-th rollers.

Further, the method of manufacturing a carbon fiber bundle includes obtaining a stabilized fiber bundle by the above-mentioned method and carbonizing the stabilized fiber bundle in an inert atmosphere at 1000 to 2500° C.

According to the method of manufacturing a stabilized fiber bundle and the method of manufacturing a carbon fiber bundle, it is possible to suppress adhesion between the single fibers that constitute the fiber bundle, which may occur during the stabilization treatment, and to manufacture a polyacrylonitrile carbon fiber bundle having high tensile strength.

DESCRIPTION OF REFERENCE SIGNS

Figure 1:
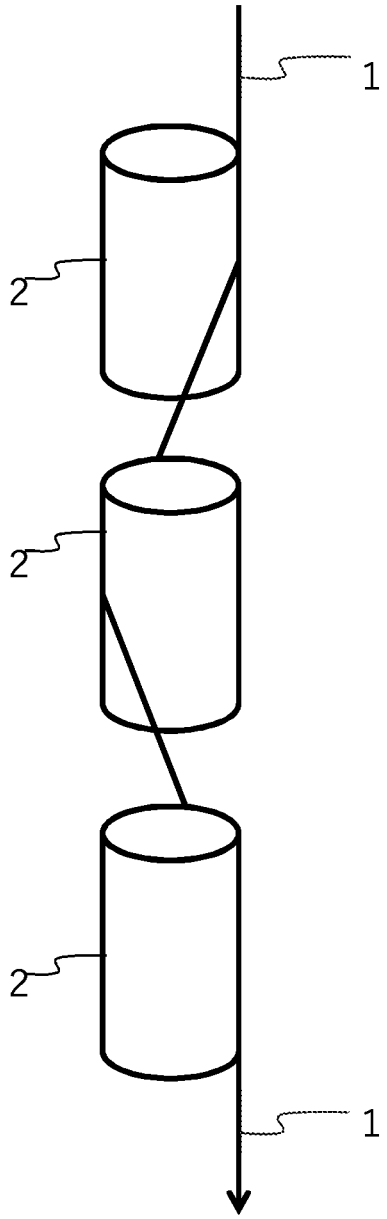
FIG. 1 is a schematic configuration diagram showing an example of a roller group.

1 Intermediate fiber bundle of stabilized fiber bundle
2 Roller
3 Center of roller
θ1, θ2, θ3 Contact angle

DETAILED DESCRIPTION

The polyacrylonitrile precursor fiber bundle used as a raw material of the carbon fiber bundle can be obtained, for example, by spinning using, as an acrylic polymer, a homopolymer or a copolymer of acrylonitrile, and an organic or inorganic solvent. The acrylic polymer is a polymer containing 90 mass % or more of acrylonitrile, and may contain 10 mass % or less of other comonomers as necessary. Examples of the comonomers include acrylic acid, methacrylic acid, itaconic acid, and methyl esters, ethyl esters, propyl esters, butyl esters, alkali metal salts, and ammonium salts of these compounds, as well as allyl sulfonic acid, methallyl sulfonic acid, styrene sulfonic acid, and alkali metal salts of these compounds, but are not particularly limited.

The method of manufacturing the polyacrylonitrile precursor fiber bundle is not particularly limited. Preferable examples of a method of spinning a fiber from a spinning dope include wet spinning in which a fiber is spun into a solvent in a coagulation bath, and dry-jet wet spinning in which a fiber is spun from a spinning dope once into the air. After spinning, the spun yarn is subjected to steps such as drawing, washing with water, addition of an oil agent, drying and densification, and if necessary, post-drawing to provide a polyacrylonitrile precursor fiber bundle.

The polyacrylonitrile precursor fiber bundle preferably has a single fiber fineness of 0.4 to 1.6 dtex. In addition, the polyacrylonitrile precursor fiber bundle preferably has a number of filaments, which is the total number of single fibers that constitute the polyacrylonitrile precursor fiber bundle, of 1,000 to 60,000, and the number of filaments is more preferably 1,000 to 36,000.

The polyacrylonitrile precursor fiber bundle is stabilized in an oxidizing atmosphere at 200 to 300° C. to manufacture a stabilized fiber bundle. The gas used as the oxidizing atmosphere is preferably the air in terms of cost. The oxidation oven is preferably a circulating hot air oven. It is preferable that the oxidation oven have, at both ends inside or outside thereof, folding rollers in multiple stages so that the fiber bundle can repeatedly run a plurality of times. The oxidation oven may be either a horizontal oxidation oven in which the fiber bundle runs in a horizontal direction, or a vertical oxidation oven in which the fiber bundle runs in a vertical direction. A horizontal oxidation oven is preferable because the oven facilitates handling of the fiber bundle in threading and yarn separating. The fiber bundle that has traversed through the oxidation oven is reversed in the running direction by the folding rollers and repeatedly passes through the oxidation oven so that the fiber bundle may be heated by the circulated hot air, whereby the polyacrylonitrile precursor fiber bundle is stabilized. In this process, for a carbon fiber bundle manufactured from the stabilized fiber bundle to easily exhibit sufficient tensile strength, it is preferable that the single fibers of the fiber bundle heat-treated in the stabilization heat treatment oven have a fineness of 0.4 to 1.7 dtex.

The fiber bundle may have a form of either a non-twisted yarn having no twist or a twisted yarn having a number of twists in a certain direction, and is not particularly limited.

When the polyacrylonitrile precursor fiber bundle is heat-treated in the stabilization process, adhesion between the single fibers that may occur in the heat treatment during the stabilization treatment is suppressed as follows: a fiber bundle is made to run with respect to a roller group including m pieces (where m is an integer of 3 or more) of rollers arranged continuously, to sequentially pass between an n-th roller and an (n+1)-th roller (where n is an integer of 1 or more and (m−1) or less), the m pieces of rollers arranged continuously have roller axes parallel to each other and perpendicular to the running direction of the fiber bundle, the rollers have a roller diameter of 5 to 30 mm, and the fiber bundle has a specific gravity of 1.20 to 1.50.

The fiber bundle that is made to run through the roller group may be either an intermediate fiber bundle that is in the middle of the stabilization treatment or a stabilized fiber bundle that has completed the stabilization treatment and passed through the oxidation oven.

The fiber bundle has a specific gravity of 1.20 to 1.50, and the specific gravity is preferably 1.25 to 1.45. If the specific gravity is less than 1.20, the fiber bundle is hardly stabilized and adhesion between the single fibers hardly occurs. Therefore, there is very little effect of improving the tensile strength of the carbon fiber bundle that results from peeling between the single fibers that may occur during the passage through the roller group and the consequent suppression of adhesion. If the specific gravity exceeds 1.50, not only will adhesion between the single fibers become so strong that the single fibers cannot be peeled, but also the fiber bundle will become brittle and cause fuzz during passage through the roller group so that the tensile strength may be reduced.

The rollers making up the roller group are required to have a shape having a circular cross section perpendicular to the running direction of the fiber bundle and is capable of regulating the running position of the fiber bundle. Examples of the rollers having such a shape include a flat roller, a grooved roller, a heart roller, and a cylindrical roller. It is preferable to provide a roller group for each running fiber bundle so that the running position can be controlled for each fiber bundle.

The rollers making up the roller group have a roller diameter, that is, a diameter of a roller of 5 to 30 mm, and the roller diameter is preferably 10 to 20 mm. If the roller diameter is less than 5 mm, since the roller has a thin shaft, the roller has low durability and cannot withstand long-term use. In addition, contact between the roller and the fiber bundle is insufficient, resulting in lower peeling properties for peeling the adhered single fibers of the fiber bundle as well as little effect of suppressing adhesion. Alternatively, if the roller diameter exceeds 30 mm, since the rollers have little effect of bending the fiber bundle running thereon, sufficient external force does not act on the fiber bundle so that suppression of adhesion exerted by peeling between the single fibers may become insufficient.

The rollers are arranged continuously and the fiber bundle is made to run on the rollers sequentially so that the single fibers that constitute the fiber bundle are continuously spread and the adhesion is suppressed. For that purpose, three or more rollers are required. Among the three or more rollers that are arranged continuously, the fiber bundle contacts the rollers present between the first roller and the last roller for the longest period and is spread. Therefore, such rollers have the largest effect of peeling between the single yarns to suppress adhesion. Although there is no upper limit on the number of such rollers, twenty rollers are sufficient. This is because the effect of peeling the fiber bundle by running on the rollers is plateaued, and a large number of rollers may conversely cause a problem of fuzz of the fiber bundle.

It is also necessary that the roller axes be parallel to each other for running stability of the fiber bundle. If the roller axes are not parallel to each other, the fiber bundle may be displaced to the end of the rollers to fall off from the rollers so that running stability of the fiber bundle cannot be ensured. In addition, our methods can be applied to both one fiber bundle and a plurality of fiber bundles running in parallel at the same time. It is also possible to arrange the rollers in a state where the centers of axes of the rollers making up the roller group are not on one straight line, but it is preferable that all the center axes of the rollers be parallel to the running direction of the fiber bundle and on one straight line as shown in FIG. 1. This is because it is preferable to reduce the installation space of the rollers, and uniform application of the external force to the fiber bundle on the rollers makes the peeling of the single yarns uniform so that the suppression of adhesion between the single yarns is better controlled, resulting in ease of obtaining the effect of improving the tensile strength of the carbon fiber bundle.

To make the fiber bundle run on the rollers and suppress adhesion between the single yarns by the peeling at the time of spreading, it is necessary to apply appropriate external force to the fiber bundle running on the rollers. For that purpose, the positions of three or more continuously arranged rollers, in other words, the distance between the roller axes is important. The term "roller axis" as used herein refers to a straight line formed by extending the center point of a circular cross section of a roller, which is perpendicular to the running direction of the fiber bundle, in the length direction of the roller. The distance between the axes may be the same or different from each other between the rollers making up the roller group. Since m pieces of rollers are arranged continuously, m is an integer of 3 or more.

Further, condition (a) is satisfied: (a) $L_n$ satisfies $0.75\times(R_n+R_{n+1})\leq L_n\leq 2.0\times(R_n+R_{n+1})$, wherein $R_n$ [mm] is a roller diameter of an n-th roller, $R_{n+1}$ [mm] is a roller diameter of an (n+1)-th roller, and $L_n$ [mm] is a distance between an n-th roller axis and an (n+1)-th roller axis. That is, the diameter of the first roller arranged on the upstream side in the running direction of the fiber bundle is defined as $R_1$ (mm), the diameter of the n-th roller is defined as $R_n$ (mm), and the diameter of the last m-th roller is defined as $R_m$ (mm). Further, it is important that $L_n$ satisfy the relational expression $0.75\times(R_n+R_{n+1})\leq L_n\leq 2.0\times(R_n+R_{n+1})$, wherein $L_n$ (mm) is the distance between an n-th roller axis and an (n+1)-th roller axis to obtain the effect of suppressing adhesion between the single yarns. If $L_n$ is less than $0.75\times(R_n+R_{n+1})$, since the distance between the roller axes is shorter, when the fiber bundle runs with fuzz balls being attached thereto, the space between the rollers may be clogged with the fuzz balls and fuzz or yarn break may occur. Conversely, if $L_n$ exceeds $2.0\times(R_n+R_{n+1})$, since the distance between the roller axes is longer, contact of the rollers with the fiber bundle is insufficient, and the effect of suppressing adhesion between the single fibers is reduced. Moreover, since a large space is required to arrange the rollers making up the roller group, productivity of the equipment is deteriorated.

The fiber bundle is spread on the rollers making up the roller group to apply external force to the fiber bundle. The width $W_0$ of the fiber bundle before coming into contact with the first roller and the width $W_2$ of the fiber bundle immediately after leaving the last m-th roller is preferably the same. This is because, when a plurality of fiber bundles subjected to the stabilization treatment run at the same time, the width of the running fiber bundle that remains unchanged avoids the necessity of changing the width of the folding roller or the heat treatment oven. However, since the fiber bundle is spread on the plurality of rollers making up the roller group, the fiber bundle may run with the width $W_2$ immediately after the passage on the last m-th roller being still wide. Therefore, it is necessary that condition (c) is satisfied: (c) the width $W_2$ of the fiber bundle after leaving the m-th roller satisfies $1.0\leq W_2/W_0\leq 1.1$.

Condition (b) is satisfied: (b) the width $W_0$ of the fiber bundle before coming into contact with the first roller is in a range of $2.0\times10^{-4}$ to $6.0\times10^{-4}$ mm/dtex. The range is preferably $3.0\times10^{-4}$ to $5.0\times10^{-4}$ mm/dtex. If the width $W_0$ of the fiber bundle is less than $2.0\times10^{-4}$ mm/dtex, since the fiber bundle is thin, spreading of the fiber bundle on the rollers is insufficient, and the peeling necessary to suppress adhesion between the single yarns is insufficient. Moreover, since heat is accumulated in the fiber bundle during the stabilization treatment, fuzz or yarn break may easily occur, or fuzz may easily occur during running on the rollers. Conversely, if the width $W_0$ of the fiber bundle exceeds $6.0\times10^{-4}$ mm/dtex, since the fiber bundle is already wide, the fiber bundle is hardly spread on the rollers, and the effect of suppressing the adhesion between the single yarns is small.

In addition, as for the fiber bundle on the second to (m−1)-th rollers arranged between the first and last rollers, a largest effect of suppressing adhesion, that is, effect of spreading the fiber bundle and peeling the adhered single fibers is exhibited. Therefore, the fiber bundle is spread so that condition (d) is satisfied: the width $W_1$ of the fiber bundle on second to (m−1)-th rollers satisfies $W_1/W_0\geq 1.4$ in all the second to (m−1)-th rollers. If the spreading ratio $W_1/W_0$ is less than 1.4 times, the fiber bundle is insufficiently spread and the adhered single fibers cannot be peeled, and the tensile strength of the carbon fiber bundle is not improved. There is no upper limit on the spreading ratio $W_1/W_0$ as long as the running stability of the fiber bundle on the rollers can be ensured, and a spreading ratio of at most 2.0 times can sufficiently exhibit the desired effect.

Figure 2:
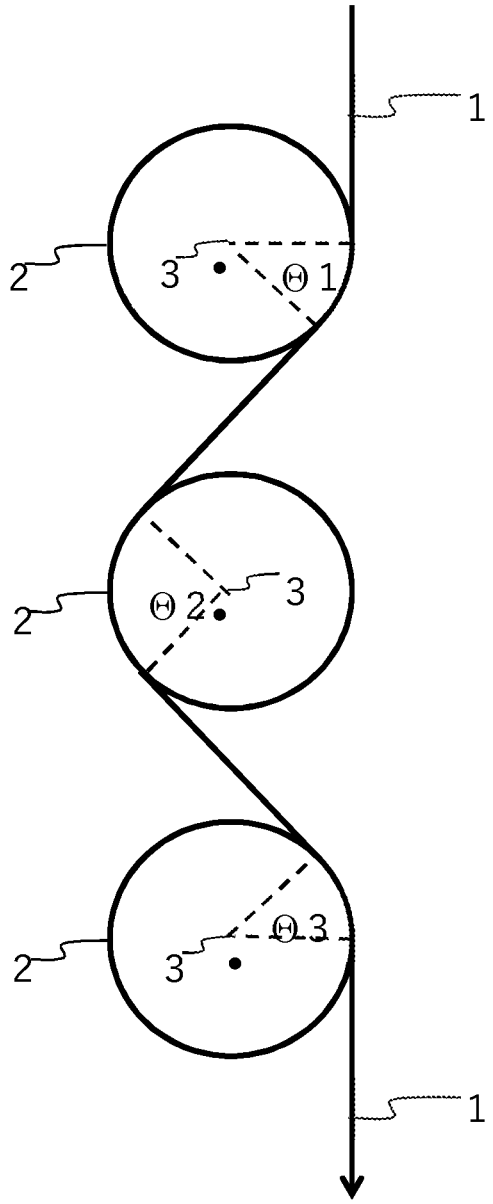
FIG. 2 is a top view of the roller group shown in FIG. 1.

To further suppress adhesion between the single fibers that may occur during the stabilization treatment, it is preferable to adjust the angle at which the fiber bundle running on a roller contacts the roller (hereinafter sometimes referred to as the "contact angle") as follows. That is, for the first roller and the last m-th roller, the contact angle of the fiber bundle with the roller is preferably 15 to 70°, more preferably 30 to 60°. Further, for the second to (m−1)-th rollers arranged between the first roller and the last roller, the contact angle of the fiber bundle with the roller is preferably 30 to 140°, more preferably 60 to 120°. The "contact angle" means, as shown in FIG. 2, in a cross section perpendicular to the running direction of the fiber bundle, that is, in a circle in top view, the center angle of a sector formed by three points including the center of the roller, the point at which the fiber bundle starts to contact with the roller on the circumference of the roller, and the end point of contact at which the fiber bundle ceases to contact with the roller on the circumference of the roller. When the contact angle is within the above-mentioned range, the fiber bundle is sufficiently spread during running on the rollers, the external force is easily applied to the fiber bundle, and the single fibers that constitute the fiber bundle are peeled so that single fibers that may occur during the stabilization treatment can be easily suppressed. Moreover, it becomes easier to suppress fuzz due to excessive contact with the rollers to maintain the grade of the fiber bundle. The contact angle can be adjusted by changing the roller diameter or the distance between the roller axes.

Further, as another factor further suppressing adhesion between the single fibers, it is preferable to adjust the tension of the fiber bundle during running on the rollers as follows. That is, the fiber bundle preferably has a tension of 30 to 180 mg/dtex, and the tension is more preferably 50 to 150 mg/dtex. When the tension of the fiber bundle is 30 to 180 mg/dtex, the fiber bundle is spread and external force is applied to the fiber bundle during running on the rollers so that the single fibers that constitute the fiber bundle are subjected to a peeling action and the adhesion between the single fibers can be more easily suppressed. Moreover, it becomes easier to suppress fuzz of the fiber bundle due to excessive tension to maintain the grade of the fiber bundle. The "tension" of the fiber bundle is an average of the tension before the fiber bundle comes into contact with the first roller and the tension after the fiber bundle leaves the last roller that are measured with a tension meter. The tension meter used may be a digital tension meter because of high accuracy.

The place to arrange the rollers is preferably outside the oxidation oven where the fiber bundle is not stabilized. Specifically, since the purpose of arranging the rollers is to suppress adhesion between the single yarns that may occur during the stabilization treatment, it is preferable to arrange the rollers at a place where the fiber bundle is not stabilized. In particular, it is more suitable that the ambient temperature around the place where the rollers are arranged be on the ordinary temperature level since the fiber bundle running on the rollers will also have a temperature on the ordinary temperature level, and adhesion between the single yarns due to heat will be less likely to occur. More specifically, the rollers may be arranged at a place between the oxidation ovens or after the oxidation oven through which the stabilized fiber bundle runs to pass, or between the folding roller and the oxidation oven in the stabilization process.

The method of manufacturing a carbon fiber bundle includes the steps of obtaining a stabilized fiber bundle by the method of manufacturing a stabilized fiber bundle, and carbonizing the stabilized fiber bundle in an inert atmosphere at 1000 to 2500° C. As a specific example of the above-mentioned method, for example, a stabilized fiber bundle obtained by the method of manufacturing a stabilized fiber bundle described above is precarbonized in an inert atmosphere such as nitrogen at a temperature of 300 to 1000° C., and then carbonized in an inert atmosphere such as nitrogen at a temperature of 1000 to 2000° C. to provide a carbonized fiber bundle. Moreover, it is possible to provide a graphitized fiber bundle having a higher elastic modulus by carbonizing the fiber bundle in an inert atmosphere such as nitrogen at a higher temperature of 2000 to 2500° C. The carbon fiber bundle may be either of the above-mentioned carbonized fiber bundle or graphitized fiber bundle.

After the carbonization treatment, it is preferable to subject the carbon fiber bundle to oxidative surface treatment for the purpose of generating a functional group on the surface of the carbon fiber bundle to improve adhesiveness with a matrix resin. Examples of the oxidative surface treatment method include liquid phase oxidation using a chemical solution, electrochemical treatment of fiber surface in which the carbon fiber bundle as an anode is treated in an electrolytic solution, and gas phase oxidative surface treatment by plasma treatment or the like in a phase state. The method of electrochemical treatment of fiber surface is preferable because the method is relatively good in handleability and is advantageous in terms of manufacturing cost. An electrolytic solution used in the electrochemical treatment of fiber surface may be either an acidic aqueous solution or an alkaline aqueous solution. The acidic aqueous solution is preferably sulfuric acid or nitric acid having strong acidity. The alkaline aqueous solution is preferably an aqueous solution of an inorganic alkali such as ammonium carbonate, ammonium hydrogen carbonate, or ammonium bicarbonate.

When the carbon fiber bundle is subjected to such electrochemical treatment of fiber surface, it is preferable to apply a sizing agent to the carbon fiber bundle after the carbon fiber bundle is subjected to a water washing step as necessary and then water is evaporated with a drier. The type of the sizing agent is not particularly limited, and the sizing agent may be appropriately selected from a bisphenol A epoxy resin containing an epoxy resin as a main component, a polyurethane resin and the like according to the matrix resin used in higher-order processing.

EXAMPLES

Hereinafter, our methods are described in detail by way of examples. In the examples, when the number of rollers is three (n=1 or 2, and m=3) or thirteen (n is an integer of 1 to 12, and m=13) are described, but the number of rollers is not limited to these. In each of the examples, $L_n$ satisfies $0.75\times(R_n+R_{n+1})\leq L_n\leq 2.0\times(R_n+R_{n+1})$, wherein $R_n$ is the roller diameter of the n-th roller, $R_{n+1}$ is the roller diameter of the (n+1)-th roller, and $L_n$ is the distance between the n-th roller axis and the (n+1)-th roller axis. The characteristics were evaluated according to the following methods.

Spreading Ratio of Fiber Bundle

In the measurement of the widths $W_0$, $W_1$, and $W_2$ of a fiber bundle, $W_0$ is measured for the fiber bundle immediately before coming into contact with the first roller, $W_1$ is measured for the fiber bundle running on a roller or rollers, and $W_2$ is measured for the fiber bundle immediately after leaving the last roller. As for the reading accuracy, the widths of the fiber bundle were measured in the unit of mm to one decimal place, that is, to the unit of 0.1 mm. The widths of the fiber bundle were measured with the naked eye using a ruler. The ruler used was a first grade stainless steel metal straight ruler specified in JIS B7516 (2005). The spreading ratios $W_2/W_0$ and $W_1/W_0$ were calculated from the obtained widths $W_0$, $W_1$, and $W_2$ of the fiber bundle.

Tension of Fiber Bundle

The tension of a running fiber bundle was measured for the fiber bundle before coming into contact with the first roller and the fiber bundle after leaving the last roller. The tension meter used was a high-performance handheld digital tension meter manufactured by NIDEC-SHIMPO CORPORATION, and the tension was measured for 5 seconds. The average of the tension of the fiber bundle before coming into contact with the first roller and the tension of the fiber bundle after leaving the last roller was defined as the tension of the fiber bundle.

Specific Gravity of Fiber Bundle

The specific gravity of a fiber bundle was measured according to the method described in JIS R7601 (2006). The specific gravity was measured using a fiber bundle before being made to run through a roller group. A reagent used was ethanol (a special grade reagent manufactured by Wako Pure Chemical Industries, Ltd.) without purification. A fiber bundle weighing 1.0 to 1.5 g was collected and absolutely dried at 120° C. for 2 hours. The absolute dry mass (A) of the fiber bundle was measured, then the fiber bundle was impregnated with ethanol having a known specific gravity (specific gravity $\tau$), and the mass (B) of the fiber bundle in ethanol was measured. The specific gravity was calculated according to the following formula:

$$\text{Specific gravity}=(A\times\rho)/(A-B).$$

Tensile Strength of Carbon Fiber Bundle

The tensile strength of a carbon fiber bundle was determined according to "Carbon fiber—Determination of tensile properties of resin-impregnated yarn" of JIS R7608 (2007) following the procedure described below. The resin formulation used was "Celloxide (registered trademark)" 2021P (manufactured by Daicel Chemical Industries, Ltd.)/boron trifluoride monoethylamine (manufactured by Tokyo Chemical Industry Co., Ltd.)/acetone=100/3/4 (parts by mass). The curing conditions were a pressure of ordinary pressure, a temperature of 125° C., and a time of 30 minutes. Five carbon fiber bundles were measured, and the average thereof was taken as the tensile strength of the carbon fiber bundle.

Example 1

A spinning dope was prepared from an acrylic polymer, and then a polyacrylonitrile precursor fiber having a single fiber fineness of 1.1 dtex and a number of filaments of 12,000 was obtained by a wet spinning method. The polyacrylonitrile precursor fiber bundle was stabilized in an oxidizing atmosphere containing the air at 230 to 270° C., and after completion of the stabilization treatment, a stabilized fiber bundle having a specific gravity of 1.38 was obtained. The stabilized fiber bundle was passed through a roller group including three cylindrical rollers arranged between an oxidation oven and a precarbonization oven so that the center axes of the rollers might be on one straight line as shown in FIG. 1. All the three rollers had a diameter of 10 mm, that is, $R_1$, $R_2$, and $R_3$ were all 10 mm. The three rollers were arranged so that both the distances $L_1$ and $L_2$ between the centers of the rollers might be 20 mm, that is, the gaps between the rollers might be 10 mm. In this example, for the distances $L_1$ and $L_2$ corresponding to $L_n$, the relational expression $0.75\times(R_n+R_{n+1})\leq L_n\leq 2.0\times(R_n+R_{n+1})$ is established. The widths $W_0$ and $W_2$ of the stabilized fiber bundle were $3.0\times10^{-4}$ mm/dtex, that is, $W_2/W_0$ was 1.0, and the spreading ratio $W_1/W_0$ on the second roller was 1.4. The contact angles $\theta_1$ and $\theta_3$ of the stabilized fiber bundle with the first roller and the last roller, respectively, were 30°, and the contact angle $\theta_2$ of the stabilized fiber bundle with the second roller was 60°. The stabilized fiber bundle running on the rollers had a tension of 70 mg/dtex.

The stabilized fiber bundle was precarbonized in a nitrogen atmosphere at 700° C., then carbonized at 1400° C., and then subjected to electrochemical treatment of fiber surface using sulfuric acid as an electrolytic solution, and a sizing agent containing a bisphenol A epoxy resin as a main component was added to the stabilized fiber bundle to give a carbon fiber bundle. The obtained carbon fiber bundle had a tensile strength of 430 kgf/mm$^2$. The results are shown in Tables 1 and 2.

Example 2

A carbon fiber bundle was obtained in the same manner as in Example 1 except that an intermediate fiber bundle heat-treated at a stabilization temperature of 220 to 230° C. and having a specific gravity of 1.20 was passed on rollers arranged between a folding roller and an oxidation oven, and then stabilized at 230 to 270° C. to give a stabilized fiber bundle. The obtained carbon fiber bundle had a tensile strength of 450 kgf/mm$^2$. The results are shown in Tables 1 and 2.

Example 3

A carbon fiber bundle was obtained in the same manner as in Example 1 except that an intermediate fiber bundle heat-treated at a stabilization temperature of 220 to 235° C. and having a specific gravity of 1.25 was passed on rollers arranged between a folding roller and an oxidation oven, and then stabilized at 235 to 270° C. to give a stabilized fiber bundle. The obtained carbon fiber bundle had a tensile strength of 460 kgf/mm$^2$. The results are shown in Tables 1 and 2.

Example 4

A carbon fiber bundle was obtained in the same manner as in Example 1 except that the stabilized fiber bundle stabilized at a stabilization temperature of 230 to 280° C. had a specific gravity of 1.50. The obtained carbon fiber bundle had a tensile strength of 440 kgf/mm$^2$. The results are shown in Tables 1 and 2.

Example 5

A carbon fiber bundle was obtained in the same manner as in Example 1 except that a polyacrylonitrile precursor fiber having a single fiber fineness of 0.9 dtex and a number of filaments of 12,000 was obtained, and that the width $W_0$ of the fiber bundle was changed to $6.0\times10^{-4}$ mm/dtex. The obtained carbon fiber bundle had a tensile strength of 440 kgf/mm$^2$. The results are shown in Tables 1 and 2.

Example 6

A carbon fiber bundle was obtained in the same manner as in Example 1 except that the roller diameter was 5 mm, both the distances $L_1$ and $L_2$ between the centers of the rollers were 15 mm, the contact angles $\theta_1$ and $\theta_3$ of the stabilized fiber bundle with the first roller and the last roller, respectively, were 15°, and the contact angle $\theta_2$ of the stabilized fiber bundle with the second roller was 30°. In this example, for the distances $L_1$ and $L_2$ corresponding to $L_n$, the relational expression $0.75\times(R_n+R_{n+1})\leq L_n\leq 2.0\times(R_n+R_{n+1})$ is established. The obtained carbon fiber bundle had a tensile strength of 400 kgf/mm$^2$. The results are shown in Tables 1 and 2.

Example 7

A carbon fiber bundle was obtained in the same manner as in Example 1 except that the roller diameter was 30 mm, both the distances $L_1$ and $L_2$ between the centers of the rollers were 45 mm, that is, the gaps between the rollers were 15 mm, the contact angles $\theta_1$ and $\theta_3$ of the stabilized fiber bundle with the first roller and the last roller, respectively, were 24°, and the contact angle $\theta_2$ of the stabilized fiber bundle with the second roller was 48°. In this example, for the distances $L_1$ and $L_2$ corresponding to $L_n$, the relational expression $0.75\times(R_n+R_{n+1})\leq L_n\leq 2.0\times(R_n+R_{n+1})$ is established. The obtained carbon fiber bundle had a tensile strength of 430 kgf/mm$^2$. The results are shown in Tables 1 and 2.

Example 8

A carbon fiber bundle was obtained in the same manner as in Example 1 except that the number of filaments of the polyacrylonitrile precursor fiber bundle was changed to 4,000, and that the width $W_0$ of the fiber bundle was changed to $2.0\times10^{-4}$ mm/dtex. The obtained carbon fiber bundle had a tensile strength of 420 kgf/mm$^2$. The results are shown in Tables 1 and 2.

Example 9

A carbon fiber bundle was obtained in the same manner as in Example 1 except that the number of rollers was changed to thirteen. In this example, all the thirteen rollers had a diameter of 10 mm, and the rollers were arranged so that all the distances between the centers of the rollers might be 20 mm, that is, the gaps between the rollers might be 10 mm, and that all the center axes of the rollers might be on one straight line. The spreading ratio $W_1/W_0$ was 1.4 on all the second to twelfth rollers. The obtained carbon fiber bundle had a tensile strength of 460 kgf/mm$^2$. The results are shown in Tables 3 and 4.

Example 10

Figure 3:
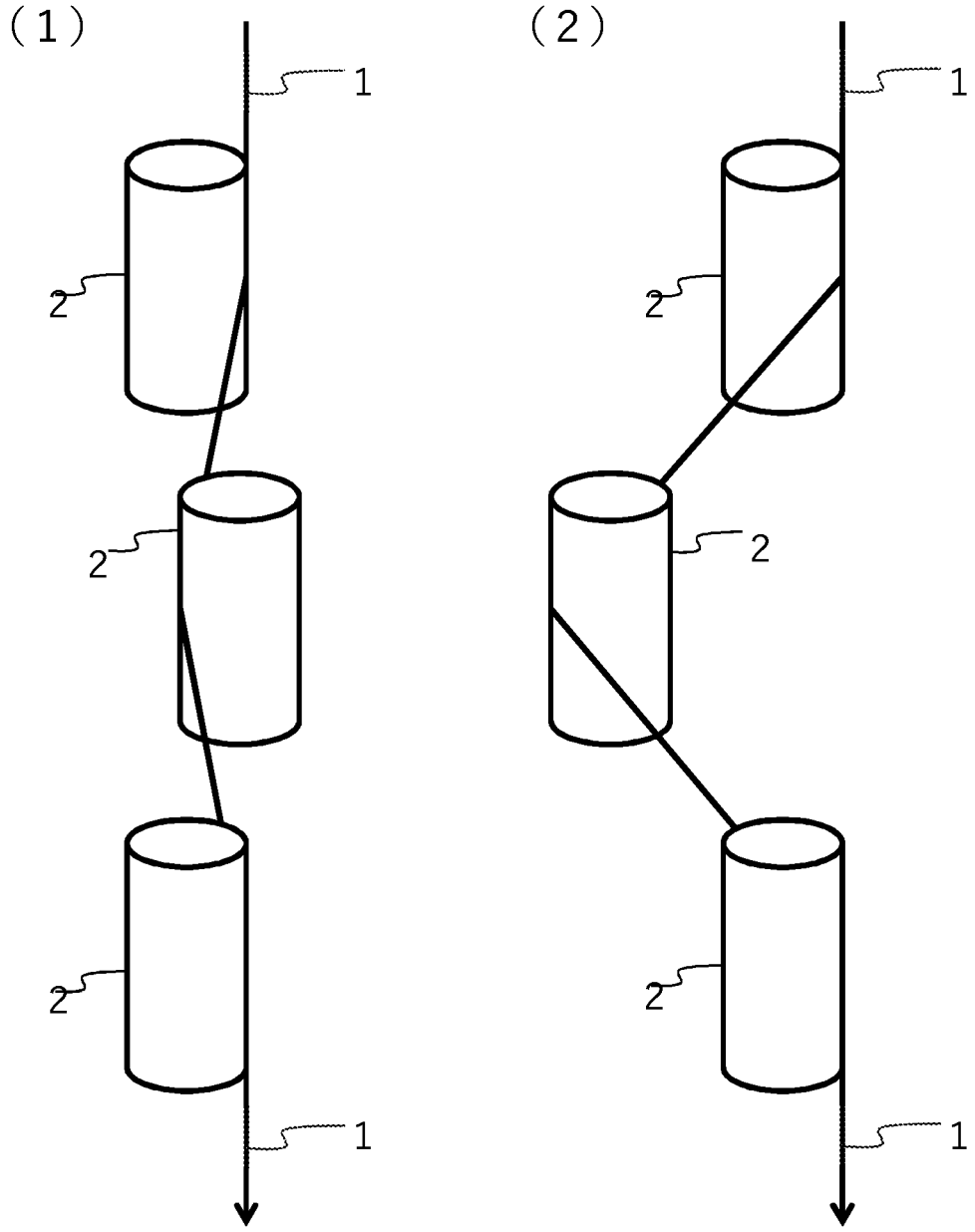
FIGS. 3(1) and 3(2) are schematic configuration diagrams showing other examples of the roller group.

A carbon fiber bundle was obtained in the same manner as in Example 1 except that as shown in FIG. 3(1), the second roller was displaced by 5 mm in the direction perpendicular to the running direction of the stabilized fiber bundle to adjust the contact angles $\theta_1$ and $\theta_3$ of the stabilized fiber bundle with the first roller and the third roller, respectively, to 15°, and to adjust the contact angle $\theta_2$ of the stabilized fiber bundle with the second roller to 30°. In this example, the distances $L_1$ and $L_2$ between the roller axes were 21 mm, but the relational expression $0.75\times(R_1+R_{n+1})\leq L_n\leq 2.0\times(R_1+R_{n+1})$ is established. The obtained carbon fiber bundle had a tensile strength of 400 kgf/mm$^2$. The results are shown in Tables 3 and 4.

Example 11

A carbon fiber bundle was obtained in the same manner as in Example 1 except that as shown in FIG. 3(2), the second roller was displaced by 25 mm in the direction perpendicular to the running direction of the stabilized fiber bundle to adjust the contact angles $\theta_1$ and $\theta_3$ of the stabilized fiber bundle with the first roller and the third roller, respectively, to 70°, and to adjust the contact angle $\theta_2$ of the stabilized fiber bundle with the second roller to 140°. In this example, the distances $L_1$ and $L_2$ between the roller axes were 32 mm, but the relational expression $0.75\times(R_1+R_{n+1})\leq L_n\leq 2.0\times(R_1+R_{n+1})$ is established. The obtained carbon fiber bundle had a tensile strength of 430 kgf/mm$^2$. The results are shown in Tables 3 and 4.

Example 12

A carbon fiber bundle was obtained in the same manner as in Example 1 except that the tension of the stabilized fiber bundle was changed to 30 mg/dtex. The obtained carbon fiber bundle had a tensile strength of 400 kgf/mm$^2$. The results are shown in Tables 3 and 4.

Example 13

A carbon fiber bundle was obtained in the same manner as in Example 1 except that the tension of the stabilized fiber bundle was changed to 180 mg/dtex. The obtained carbon fiber bundle had a tensile strength of 410 kgf/mm$^2$. The results are shown in Tables 3 and 4.

Comparative Example 1

A carbon fiber bundle was obtained in the same manner as in Example 1 except that the three rollers arranged so that the center axes of the rollers might be on one straight line were absent. Since adhesion between the single yarns occurred in the stabilized fiber bundle, the tensile strength of the carbon fiber bundle was as low as 340 kgf/mm$^2$. The results are shown in Tables 3 and 4.

Comparative Example 2

A stabilized fiber bundle was made to run in the same manner as in Example 1 except that the roller diameter was 3 mm, the contact angles $\theta_1$ and $\theta_3$ of the stabilized fiber bundle with the first roller and the last roller, respectively, were 11°, and the contact angle $\theta_2$ of the stabilized fiber bundle with the second roller was 22°. Since the roller diameter was small, the roller was bent and the fiber bundle could not be made to run, and no carbon fiber bundle was obtained. In this example, the distances $L_1$ and $L_2$ between the centers of the rollers were 13 mm, that is, the gaps between the rollers were 10 mm, and the relational expression $0.75\times(R_n+R_{n+1})\leq L_n\leq 2.0\times(R_1+R_{n+1})$ is not established. The results are shown in Tables 3 and 4.

Comparative Example 3

A carbon fiber bundle was obtained in the same manner as in Example 1 except that the roller diameter was 35 mm, the contact angles $\theta_1$ and $\theta_3$ of the stabilized fiber bundle with the first roller and the last roller, respectively, were 26°, and the contact angle $\theta_2$ of the stabilized fiber bundle with the second roller was 52°. Since the roller diameter was large and the effect of bending the stabilized fiber bundle running on the rollers was small, sufficient external force did not act on the stabilized fiber bundle. Therefore, the effect of suppressing adhesion that is exerted by peeling of the single fibers that constitute the stabilized fiber bundle was insufficient, and the obtained carbon fiber bundle had a tensile strength of 370 kgf/mm$^2$. In this example, the distances $L_1$ and $L_2$ between the centers of the rollers were 45 mm, that is, the gaps between the rollers were 10 mm, and the relational expression $0.75\times(R_1+R_{n+1})\leq L_n\leq 2.0\times(R_1+R_{n+1})$ is not established. The results are shown in Tables 3 and 4.

Comparative Example 4

A carbon fiber bundle was obtained in the same manner as in Example 1 except that an intermediate fiber bundle heat-treated at a stabilization temperature of 200 to 210° C. and having a specific gravity of 1.17 was passed on rollers arranged between a folding roller and a stabilization heat treatment oven, and then stabilized at 210 to 270° C. to give a stabilized fiber bundle. Due to the low stabilization temperature, the fiber bundle during the passage on the rollers was almost not stabilized. Since the single fibers that constitute the fiber bundle did not adhere to each other, the effect of suppressing adhesion between the single fibers that is exerted by peeling between the single fibers during the passage on the rollers was not exhibited, and the obtained carbon fiber bundle had a tensile strength of 360 kgf/mm$^2$. The results are shown in Tables 5 and 6.

Comparative Example 5

A carbon fiber bundle was obtained in the same manner as in Example 1 except that the stabilized fiber bundle stabilized at a stabilization temperature of 230 to 290° C. had a specific gravity of 1.55. Adhesion between the single fibers that constitute the stabilized fiber bundle was strong, and not only the single fibers could not be peeled during passage of the stabilized fiber bundle on the rollers, but also fuzz occurred due to the brittleness of the stabilized fiber bundle, and the obtained carbon fiber bundle had a tensile strength of 370 kgf/mm$^2$. The results are shown in Tables 5 and 6.

Comparative Example 6

A carbon fiber bundle was obtained in the same manner as in Example 1 except that the number of filaments of the polyacrylonitrile precursor fiber bundle was changed to 3,000, and that the width $W_0$ of the fiber bundle was changed to $1.5\times10^{-4}$ mm/dtex. The obtained carbon fiber bundle had a tensile strength of 360 kgf/mm$^2$. The results are shown in Tables 5 and 6.

Comparative Example 7

A carbon fiber bundle was obtained in the same manner as in Example 1 except that a polyacrylonitrile precursor fiber having a single fiber fineness of 0.8 dtex and a number of filaments of 12,000 was obtained, and that the width $W_0$ of the fiber bundle was changed to $7.0\times10^{-4}$ mm/dtex. Since the width $W_0$ of the fiber bundle before coming into contact with the first roller was already large, spreading on the rollers did not occur, and the obtained carbon fiber bundle had a tensile strength of 370 kgf/mm$^2$. The results are shown in Tables 5 and 6.

Comparative Example 8

A carbon fiber bundle was obtained in the same manner as in Example 1 except that as shown in FIG. 3(1), the second roller was displaced by 7 mm in the direction perpendicular to the running direction of the stabilized fiber bundle to adjust both the distances $L_1$ and $L_2$ between the centers of the rollers to 21 mm, to adjust the contact angles $\theta_1$ and $\theta_3$ of the stabilized fiber bundle with the first roller and the third roller, respectively, to 10°, and to adjust the contact angle $\theta_2$ of the stabilized fiber bundle with the second roller to 20°. As a result, since the contact angles with the rollers were small, the stabilized fiber bundle was hardly spread on the rollers, and the spreading ratio $W_1/W_0$ was as low as 1.3. The adhesion between the single yarns that constitute the stabilized fiber bundle was not suppressed, and the obtained carbon fiber bundle had a tensile strength of 350 kgf/mm$^2$. The results are shown in Tables 5 and 6.

Comparative Example 9

A carbon fiber bundle was obtained in the same manner as in Example 1 except that as shown in FIG. 3(2), the second roller was displaced by 55 mm in the direction perpendicular to the running direction of the stabilized fiber bundle to adjust both the distances $L_1$ and $L_2$ between the centers of the rollers to 59 mm, to adjust the contact angles $\theta_1$ and $\theta_3$ of the stabilized fiber bundle with the first roller and the third roller, respectively, to 80°, and to adjust the contact angle $\theta_2$ of the stabilized fiber bundle with the second roller to 160°. Since fuzz occurred during passage on the rollers, the obtained carbon fiber bundle had a tensile strength of 340 kgf/mm$^2$. In this example, for the distances $L_1$ and $L_2$ corresponding to $L_n$, the relational expression $0.75\times(R_n+R_{n+1})\leq L_n\leq 2.0\times(R_n+R_{n+1})$ is not established. The results are shown in Tables 5 and 6.

Comparative Example 10

A carbon fiber bundle was obtained in the same manner as in Example 1 except that as a result of adjusting the tension of the stabilized fiber bundle to 20 mg/dtex, the stabilized fiber bundle was hardly spread on the rollers due to the low tension, and the spreading ratio $W_1/W_0$ was as low as 1.2. Adhesion between the single yarns that constitute the stabilized fiber bundle was not suppressed, and the obtained carbon fiber bundle had a tensile strength of 350 kgf/mm$^2$. The results are shown in Tables 5 and 6.

TABLE 1

| | Number of rollers | Roller diameter [mm] | | Distance between roller axes [mm] | | Width of fiber bundle [mm/dtex] | |
|---|---|---|---|---|---|---|---|
| | [pieces] | $R_1$ to $R_3$ | $R_4$ to $R_{13}$ | $L_1$ and $L_2$ | $L_3$ to $L_{12}$ | $W_0$ | $W_2$ |
| Example 1 | 3 | 10 | — | 20 | — | $3.0\times10^{-4}$ | $3.0\times10^{-4}$ |
| Example 2 | 3 | 10 | — | 20 | — | $3.0\times10^{-4}$ | $3.0\times10^{-4}$ |
| Example 3 | 3 | 10 | — | 20 | — | $3.0\times10^{-4}$ | $3.0\times10^{-4}$ |
| Example 4 | 3 | 10 | — | 20 | — | $3.0\times10^{-4}$ | $3.0\times10^{-4}$ |
| Example 5 | 3 | 10 | — | 20 | — | $6.0\times10^{-4}$ | $3.0\times10^{-4}$ |
| Example 6 | 3 | 5 | — | 15 | — | $3.0\times10^{-4}$ | $3.0\times10^{-4}$ |
| Example 7 | 3 | 30 | — | 45 | — | $3.0\times10^{-4}$ | $3.0\times10^{-4}$ |
| Example 8 | 3 | 10 | — | 20 | — | $2.0\times10^{-4}$ | $3.0\times10^{-4}$ |

TABLE 2

| | Spreading ratio | | Specific gravity | Contact angle [°] | | Tension [mg/dtex] | Tensile strength of carbon fiber bundle [kgf/mm$^2$] |
|---|---|---|---|---|---|---|---|
| | $W_2/W_0$ | $W_1/W_0$ | | First and last rollers | Other rollers | | |
| Example 1 | 1.0 | 1.4 | 1.38 | 30 | 60 | 70 | 430 |
| Example 2 | 1.0 | 1.4 | 1.20 | 30 | 60 | 70 | 450 |
| Example 3 | 1.0 | 1.4 | 1.25 | 30 | 60 | 70 | 460 |
| Example 4 | 1.0 | 1.4 | 1.50 | 30 | 60 | 70 | 440 |
| Example 5 | 1.0 | 1.4 | 1.38 | 30 | 60 | 70 | 440 |
| Example 6 | 1.0 | 1.4 | 1.38 | 15 | 30 | 70 | 400 |
| Example 7 | 1.0 | 1.4 | 1.38 | 24 | 48 | 70 | 430 |
| Example 8 | 1.0 | 1.4 | 1.38 | 30 | 60 | 70 | 420 |

TABLE 3

| | Number of rollers | Roller diameter [mm] | | Distance between roller axes [mm] | | Width of fiber bundle [mm/dtex] | |
|---|---|---|---|---|---|---|---|
| | [pieces] | $R_1$ to $R_3$ | $R_4$ to $R_{13}$ | $L_1$ and $L_2$ | $L_3$ to $L_{12}$ | $W_0$ | $W_2$ |
| Example 9 | 13 | 10 | 10 | 20 | 20 | $3.0 \times 10^{-4}$ | $3.0 \times 10^{-4}$ |
| Example 10 | 3 | 10 | — | 21 | — | $3.0 \times 10^{-4}$ | $3.0 \times 10^{-4}$ |
| Example 11 | 3 | 10 | — | 32 | — | $3.0 \times 10^{-4}$ | $3.0 \times 10^{-4}$ |
| Example 12 | 3 | 10 | — | 20 | — | $3.0 \times 10^{-4}$ | $3.0 \times 10^{-4}$ |
| Example 13 | 3 | 10 | — | 20 | — | $3.0 \times 10^{-4}$ | $3.0 \times 10^{-4}$ |
| Comparative Example 1 | | | | Without roller | | | |
| Comparative Example 2 | 3 | 3 | — | 13 | — | $3.0 \times 10^{-4}$ | $3.0 \times 10^{-4}$ |
| Comparative Example 3 | 3 | 35 | — | 45 | — | $3.0 \times 10^{-4}$ | $3.0 \times 10^{-4}$ |

TABLE 4

| | Spreading ratio | | Specific | Contact angle [°] | | Tension | Tensile strength of carbon fiber bundle |
|---|---|---|---|---|---|---|---|
| | $W_2/W_0$ | $W_1/W_0$ | gravity | First and last rollers | Other rollers | [mg/dtex] | [kgf/mm$^2$] |
| Example 9 | 1.0 | 1.4 | 1.38 | 30 | 60 | 70 | 460 |
| Example 10 | 1.0 | 1.4 | 1.38 | 15 | 30 | 70 | 400 |
| Example 11 | 1.0 | 1.4 | 1.38 | 70 | 140 | 70 | 430 |
| Example 12 | 1.0 | 1.4 | 1.38 | 30 | 60 | 30 | 400 |
| Example 13 | 1.0 | 1.4 | 1.38 | 30 | 60 | 180 | 410 |
| Comparative Example 1 | Without roller | | 1.38 | | Without roller | | 340 |
| Comparative Example 2 | 1.0 | 1.4 | 1.38 | 11 | 22 | 70 | — |
| Comparative Example 3 | 1.0 | 1.4 | 1.38 | 26 | 52 | 70 | 370 |

TABLE 5

| | Number of rollers | Roller diameter [mm] | | Distance between roller axes [mm] | | Width of fiber bundle [mm/dtex] | |
|---|---|---|---|---|---|---|---|
| | [pieces] | $R_1$ to $R_3$ | $R_4$ to $R_{13}$ | $L_1$ and $L_2$ | $L_3$ to $L_{12}$ | $W_0$ | $W_2$ |
| Comparative Example 4 | 3 | 10 | — | 20 | — | $3.0 \times 10^{-4}$ | $3.0 \times 10^{-4}$ |
| Comparative Example 5 | 3 | 10 | — | 20 | — | $3.0 \times 10^{-4}$ | $3.0 \times 10^{-4}$ |
| Comparative Example 6 | 3 | 10 | — | 20 | — | $1.5 \times 10^{-4}$ | $3.0 \times 10^{-4}$ |
| Comparative Example 7 | 3 | 10 | — | 20 | — | $7.0 \times 10^{-4}$ | $3.0 \times 10^{-4}$ |
| Comparative Example 8 | 3 | 10 | — | 21 | — | $3.0 \times 10^{-4}$ | $3.0 \times 10^{-4}$ |
| Comparative Example 9 | 3 | 10 | — | 59 | — | $3.0 \times 10^{-4}$ | $3.0 \times 10^{-4}$ |
| Comparative Example 10 | 3 | 10 | — | 20 | — | $3.0 \times 10^{-4}$ | $3.0 \times 10^{-4}$ |

TABLE 6

| | Spreading ratio | | Specific | Contact angle [°] | | Tension | Tensile strength of carbon fiber bundle |
|---|---|---|---|---|---|---|---|
| | $W_2/W_0$ | $W_1/W_0$ | gravity | First and last rollers | Other rollers | [mg/dtex] | [kgf/mm$^2$] |
| Comparative Example 4 | 1.0 | 1.4 | 1.17 | 30 | 60 | 70 | 360 |
| Comparative Example 5 | 1.0 | 1.4 | 1.55 | 30 | 60 | 70 | 370 |
| Comparative Example 6 | 1.0 | 1.4 | 1.38 | 30 | 60 | 70 | 360 |
| Comparative Example 7 | 1.0 | 1.4 | 1.38 | 30 | 60 | 70 | 370 |
| Comparative Example 8 | 1.0 | 1.3 | 1.38 | 10 | 20 | 70 | 350 |
| Comparative Example 9 | 1.0 | 1.4 | 1.38 | 80 | 160 | 70 | 340 |
| Comparative Example 10 | 1.0 | 1.2 | 1.38 | 30 | 60 | 20 | 350 |

The invention claimed is:

1. A method of manufacturing a stabilized fiber bundle, the method comprising the step of:

stabilizing a polyacrylonitrile precursor fiber bundle in an oxidizing atmosphere at 200 to 300° C. to manufacture a stabilized fiber bundle, wherein in the stabilizing, a fiber bundle is caused to run, with respect to a roller group including m pieces where m is an integer of 3 or more of rollers arranged continuously, to sequentially pass between an n-th roller and an (n+1)-th roller where n is an integer of 1 or more and (m−1) or less, the m pieces of rollers arranged continuously have roller axes parallel to each other and perpendicular to a running direction of the fiber bundle, the rollers have a roller diameter of 5 to 30 mm, the fiber bundle has a specific gravity of 1.20 to 1.50, and satisfies all of conditions (a) to (d) below:

(a) $L_n$ satisfies $0.75\times(R_n+R_{n+1})\leq L_n\leq 2.0\times(R_n+R_{n+1})$, wherein $R_n$ [mm] is a roller diameter of an n-th roller, $R_{n+1}$ [mm] is a roller diameter of an (n+1)-th roller, and $L_n$ [mm] is a distance between an n-th roller axis and an (n+1)-th roller axis;

(b) a width $W_0$ of the fiber bundle before contacting a first roller is $2.0\times10^{-4}$ to $6.0\times10^{-4}$ mm/dtex;

(c) a width $W_2$ of the fiber bundle after leaving an m-th roller satisfies $1.0\leq W_2/W_0\leq 1.1$; and (d) a width $W_1$ of the fiber bundle on second to (m−1)-th rollers satisfies $W_1/W_0\geq 1.4$ in all the second to (m−1)-th rollers.

2. The method according to claim 1, wherein an angle at which the fiber bundle contacts a roller is 15 to 70° for the first and m-th rollers, and is 30 to 140° for the second to (m−1)-th rollers.

3. The method according to claim 1, wherein the fiber bundle has a tension of 30 to 180 mg/dtex.

4. A method of manufacturing a carbon fiber bundle comprising:

obtaining a stabilized fiber bundle by the method according to claim 1; and carbonizing the stabilized fiber bundle in an inert atmosphere at 1000 to 2500° C.

5. The method according to claim 2, wherein the fiber bundle has a tension of 30 to 180 mg/dtex.

6. A method of manufacturing a carbon fiber bundle comprising:

obtaining a stabilized fiber bundle by the method according to claim 2; and carbonizing the stabilized fiber bundle in an inert atmosphere at 1000 to 2500° C.

7. A method of manufacturing a carbon fiber bundle comprising:

obtaining a stabilized fiber bundle by the method according to claim 3; and carbonizing the stabilized fiber bundle in an inert atmosphere at 1000 to 2500° C.

* * * * *